US005271729A

United States Patent [19]

Gensler et al.

[11] Patent Number: 5,271,729

[45] Date of Patent: Dec. 21, 1993

[54] INSPIRATED STAGED COMBUSTION BURNER

[75] Inventors: Wayne C. Gensler, Point Pleasant; John J. Van Eerden, Churchville; Chad F. Gottschlich, Philadelphia, all of Pa.

[73] Assignee: Selas Corporation of America, Dresher, Pa.

[21] Appl. No.: 957,761

[22] Filed: Oct. 7, 1992

Related U.S. Application Data

[63] Continuation of Ser. No. 795,680, Nov. 21, 1991, abandoned.

[51] Int. Cl.[5] ..... F23C 5/28

[52] U.S. Cl. ..... 431/175; 431/177; 431/284; 431/348

[58] Field of Search ..... 431/174, 175, 177, 178, 431/284, 285, 348

[56] References Cited

U.S. PATENT DOCUMENTS

| | | | |
|---|---|---|---|
| 2,152,531 | 3/1939 | Browning | 431/284 |
| 2,204,719 | 6/1940 | Zink | 431/284 |
| 2,499,707 | 3/1950 | Warren | 431/284 |
| 2,935,128 | 5/1960 | Ferguson | 431/174 |
| 4,257,762 | 3/1981 | Zink et al. | 431/348 |
| 4,887,961 | 12/1989 | Kuwabara et al. | 431/177 |

*Primary Examiner*—Carroll B. Dority
*Attorney, Agent, or Firm*—Austin R. Miller

[57] ABSTRACT

A low NOx gaseous fuel burner that creates a wall hugging flame, even in a cup. It is comprised of two staged premix units, one unit, in a cup, running very lean and the second unit, extended into the furnace, running very rich, the combination being stoichiometric.

13 Claims, 3 Drawing Sheets

INSPIRATED STAGED COMBUSTION BURNER

This application is a continuation of application Ser. No. 07/795,680, filed Nov. 21, 1991 abandoned.

BACKGROUND OF THE INVENTION

Field of the Invention

This invention relates to an inspirated burner, particularly to one for burning a gaseous fuel, and further relates to an inspirated burner for burning a gaseous fuel in separate stages in a manner to produce combustion gases having an ultra low content of nitrogen oxide. Hereinafter, nitrogen oxides, which are primarily nitric oxide and nitrogen dioxide, are collectively referred to as "NOx".

Major environmental and other problems have been encountered in the production of flue gases containing high contents of NOx. The NOx tends to react under atmospheric conditions to form environmentally unacceptable conditions, including the widely known phenomena known as urban smog and acid rain. In the United States and elsewhere, environmental legislations and restrictions have been enacted, and more are expected to be enacted in the future, severely limiting the content of NOx in flue gases.

In U.S. Pat. No. 4,874,310, granted Oct. 17, 1989 to Selas Corporation of America, the assignee hereof, a controlled primary air inspiration gas burner was disclosed, in which the introduction of control primary air was controlled in order to provide a substantial reduction of the content of nitrogen oxides in the flue gas. Such a burner includes extra piping for the introduction and control of the primary air, and this sometimes introduces expense and possible complications, especially in furnace installations utilizing a very large number of burners.

In U.S. Pat. No. 5,044,931, granted Sep. 3, 1991, Selas Corporation of America, the assignee hereof, was granted a patent for an apparatus comprising a burner which not only reduces the NOx content in the combustion gases but also radically increases the burner capacity even for the same size burner. In the burner described in this patent, secondary gaseous fuel is being burned in addition to primary gaseous fuel, and the premix introduced through the combustion passageways forms a screen of burned gases which dilute the admixture of secondary gas and secondary air, slowing the secondary fuel reaction rate. However, there are economic limitations as to the cost required in manufacturing and installing burners of the type described in the aforesaid U.S. Pat. No. 5,044,931, and it is an objective of this invention to provide a burner having a simpler and less expensive construction from the manufacturing point of view, one having a small inspirator and tip, which does not require expensive machining and which is easy to assemble. Further, it can be a direct replacement of certain existing burners without any furnace modification.

Other endeavors have been made to reduce the content of NOx in furnace flue gases but many have been found unattractive in view of their requirement of too much operator attention, and in view of the need for extremely attentive control in order to assure that there will be no violation of existing environmental laws. It is very important to be able to obtain a very substantial reduction of NOx content so that even in the event of operator error the environmental law will not be violated and the further operation of the plant and its equipment will not be enjoined by governmental action.

OBJECTS OF THE INVENTION

It is accordingly an object of the invention to provide a burner capable of using high pressure gas to inspirate the air to make premix, wherein exceedingly low NOx contents are obtainable in the exhaust gases.

It is another object to provide a burner having a low NOx emission which is less influenced by excess air, tramp air, changes in firing rate, hydrogen content in the fuel, and furnace temperature.

It is a further object of this invention to provide such a burner which can be used as a cup or flat wall burner for wall or floor mounting installations and wherein careful, delicate and precise operator control is unnecessary to achieve the desired low NOx flue gas content.

Another object of this invention is to provide a burner that can be more easily and inexpensively retrofitted to existing furnaces as well as be used in new installations, it is an objective of this invention to provide a burner that has lower manufacturing costs and that can replace certain burners in existing furnaces without having to shutdown the furnace during the replacement.

Still another object is to provide a burner capable of replacing existing burners to satisfy recently enacted NOx limits as low as 50 ppmv or 25 ppmv, all without requiring internal furnace modifications, furnace shutdown or costly refractory repair or replacement.

It is a further object to provide a new inspirator burner which is backfire resistant to 2300° F. with a turn-down of 3:1 or better on natural gas, or 2:1 while burning 50% hydrogen and 50% natural gas.

Other objects and advantages of this invention, including the simplicity, economy and easy operability of the same, and the ease with which burner may be operated to create a stable flame in a cold furnace, will become apparent hereinafter, and in the drawings of which:

DRAWINGS

DETAILED DESCRIPTION OF THE INVENTION

Figure 1:
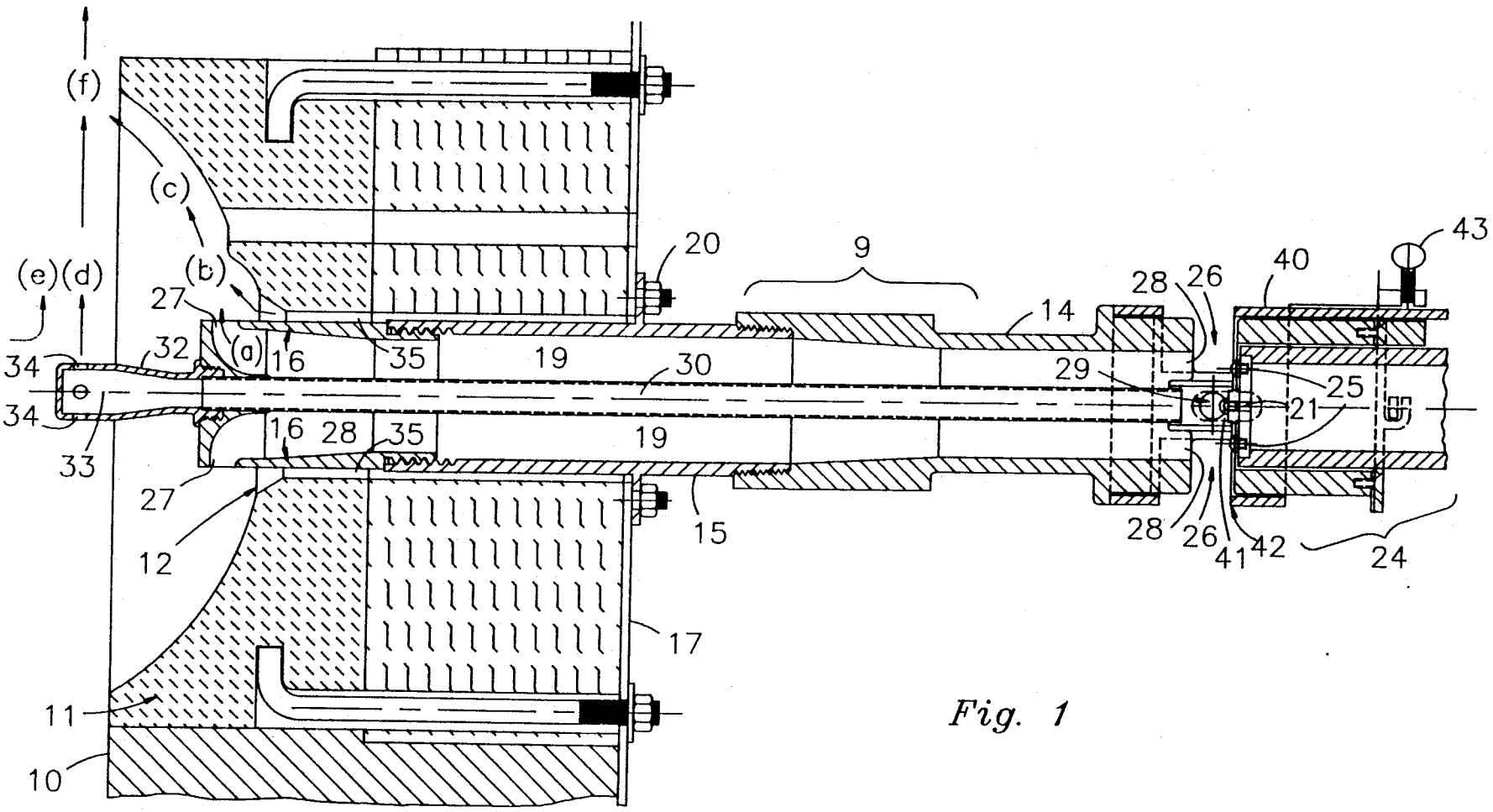
FIG. 1 is a sectional view showing a burner with first stage and second stage premix ports spaced apart from each other and embodying features of this invention and installed in a burner cup mounted in a furnace wall.

It will be appreciated that the following description is intended to refer to the specific forms of the invention selected for illustration in the drawings, and is not intended to define or limit the invention, other than in the appended claims.

In utilizing the terms "primary air" and "secondary air" in this specification, it will be understood that the expression "primary air" is intended to be directed to air mixed with the gaseous fuel in the burner before combustion begins, whereas the expression "secondary air" is intended to be applied to air mixed with the fuel after combustion has begun.

In this specification and in the claims, the numerical references in the expressions "first stage" and "second stage" or "first premix stage" and "second premix stage" are not intended to indicate any particular numerical sequence or physical location and simply indicate that the stages are separate from each other and are designed to introduce premix separately and at different locations in the combustion zone.

Figure 2:
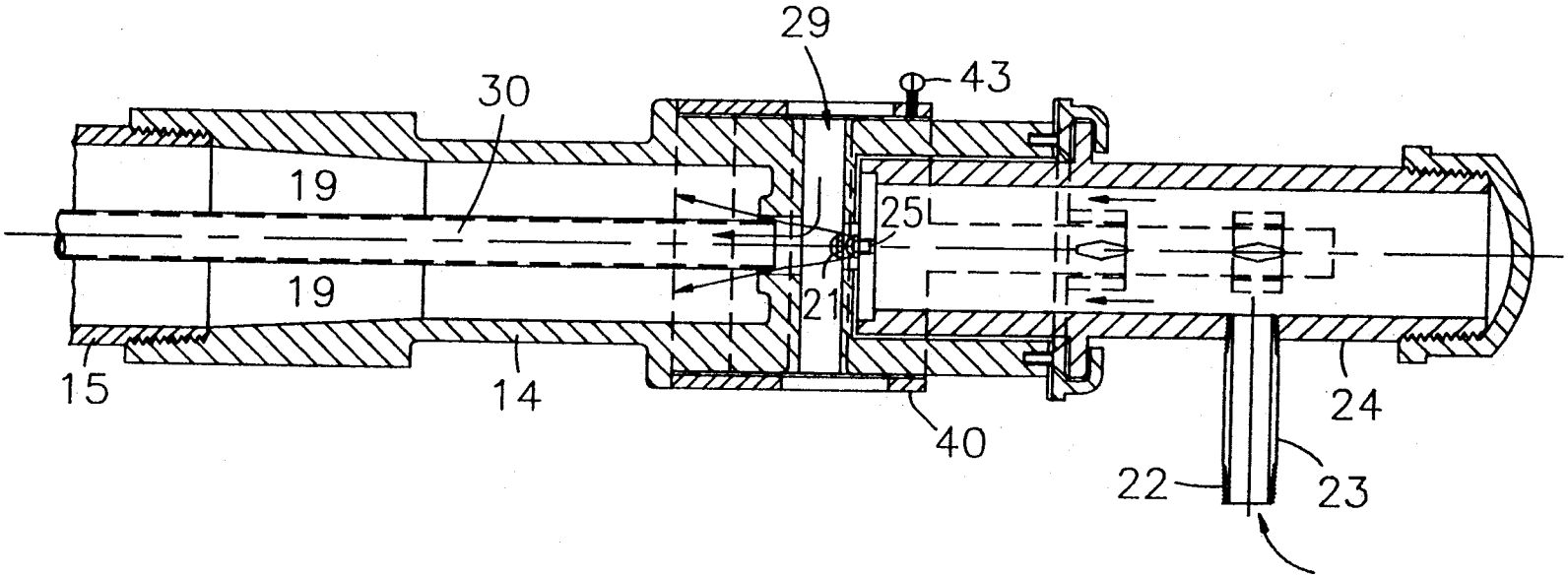
FIG. 2 is a side sectional view of an inspirator head and spud of a burner embodying features of FIG. 1.

Turning now to the specific form of the invention illustrated in the drawing, and referring particularly to FIGS. 1 and 2, the number 10 indicates a furnace wall into which is mounted a cup block 11 provided with a hole 12 for burner insertion.

As shown, the burner 9 is mounted in the hole 12 and is provided with gaseous fuel at the spud assembly 24, driven through a centrally located fuel orifice 21 and a pair of diametrically opposed fuel orifices 25 and thus formed into two separate stages of premix as will be disclosed in further detail hereinafter. The fuel inspirated through the orifice 21 mixes with primary air introduced through the air inlet opening 29 and the fuel inspirated through the orifices 25, 25 mixes with the primary air introduced through the air inlet 26 (FIG. 1). Either premix stage could be referred to as a "first" or as a "second" stage; for convenience, the stage created by the orifices 25, 25 will be called the "first premix stage."

Accordingly, the premix formed by the inspirator 21, called a "second stage," travels longitudinally inside tube 30 of the burner to the second stage burner tip 32, which projects into the combustion space, while the first stage premix formed by the inspirators 25, 25 travels along the annulus 19 to the corresponding jets 27, 27.

The number 14 designates a throat casting comprising a portion of the burner 9, which is screwed to a connecting pipe 15 screwed to the burner primary tip 16 in which the multiple ports 27 are provided. The number 20 designates mounting brackets for connecting the connecting pipe 15 to the casing 17.

As is shown in FIG. 1, a single second stage fuel orifice 21 is provided at the entrance to the second stage premix tube 30, which tube is held captive between the throat casting 14 and the primary tip 16. The numbers 25, 25 designate dual orifices for the first stage fuel, and the number 26 designates the first stage premix air inlet which is open to admit air substantially all around the circumference of the burner where closed off except at the locations of the opposed ends of the second stage air inlet conduit 29.

Inlet 26 conducts incoming air to be inspirated by the orifices 25, 25 to create premix herein referred to as "first stage premix," which flows along the annulus 19 to the first stage premix ports 27 appearing in the first stag portion of the tip 16 just downstream of the first stage premix chamber 28.

The second stage air inlet opening bears the number 29 and is separate from the inlet 26. It leads to the aforementioned second stage premix tube 30 which leads to the second stage premix tip 32 which is screwed into the first stage premix tip 16 and contains a second stage premix chamber 33 leading to second stage premix ports 34 for discharge of the second stage premix.

Looking toward the inlet end of the burner appearing in FIG. 1, an inlet air control shutter 40 is provided with a second stage air control provided with an oval-shaped slot 41, and is controlled in conjunction with a first stage air controller portion 42 which can be controlled by longitudinal sliding adjustment to increase or decrease the in-flow of primary air to both the first and second stages through the inlets 26 and 29. The number 43 designates a lock for locking the air shutter 40 in longitudinal position. Preferably, the oval-shaped opening 41 is so placed as to permit flow of secondary air only while running but to be closed when starting up.

Accordingly, with reference to FIG. 1, it will be understood that in the operation of the form of the invention shown in FIG. 1, the first stage premix flow passes out through the first stage premix ports 27 in a general direction substantially along the furnace wall or the surface of the burner cup, as indicated by the arrow (a). Secondary air, if any is optionally provided, flows outwardly through the intervening space 35 a indicated by the arrow (b). The arrow (c) designates the product of the first stage premix flow and the secondary air flow after they have mixed, and indicates the general direction of the flow of the mixture within the burner cup 11.

The arrow (d) shows the general direction of flow of the second stage premix flow, and the arrow (e) indicates the direction of flow of spent gas from previous movement within the furnace. The arrow (f) indicates the condition and general direction of flow after the mixing of the first stage and second stage streams, together with any secondary air stream if optionally provided and together with the movement of the spent gas flow (e).

Accordingly, according to this invention, the premix port 34 is "staged" or longitudinally separated from the premix ports 27 to introduce different premix flows at different locations in the area in which combustion takes place. This is an important feature and contributes many advantages as discussed in detail herein.

Turning now to FIG. 2 of the drawings, this figure shows, in side section, one form of inspirator head and spud which may be utilized in accordance with one embodiment of this invention. Parts corresponding to those in FIG. 1 are correspondingly numbered, it being kept in mind that FIG. 2 is a side view whereas FIG. 1 is a plan view.

The number 22 designates a threaded connection for the incoming fuel, which flows through the fuel pipe 23 which is threaded into the spud assembly 24. The fuel is conducted to the orifice structure carrying the orifice 21 and the dual orifices 25 comprising the second stage and first stage fuel jets 21 and 25. In this manner the first stage fuel combines with primary air introduced through the first stage air inlet 26 (FIG. 1) and passes forwardly through the first stage premix chamber 28 and out the first stage premix ports 27. Concurrently, second stage primary air flows inwardly through the second stage air inlet opening 29 (FIGS. 1 and 2) and is mixed with fuel at the second stage fuel orifice 21 and introduced into the second stage premix tube 30 for flow forwardly to the second stage premix chamber 33 and is exhausted out second stage port 34.

Preferably, the first and second stage premixes are different from each other. More preferably, the second stage premix is much richer than the first stage premix, for reasons which will become apparent hereinafter.

Figure 3:
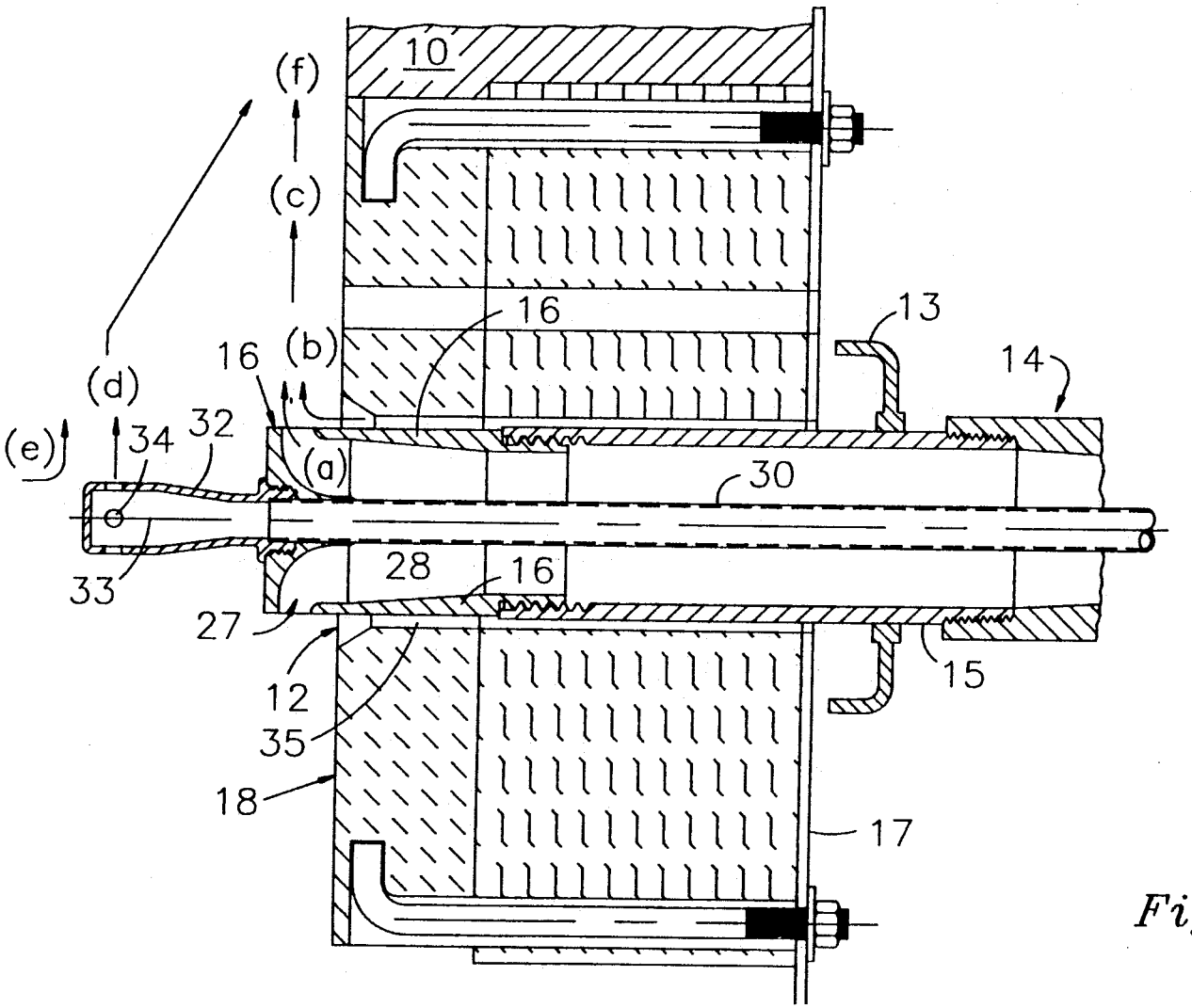
FIG. 3 is a sectional view of another embodiment of a burner according to this invention installed in a flat block in a furnace wall, with optional secondary air.

Turning now to FIG. 3 of the drawings, the number 13 designates an optional secondary air shutter 13 connected to be adjustably slidable back and forth toward and from the casing 17 to admit secondary air into the annulus 35 between the flat block 18 and the outside diameter of the first stage burner tip 16.

In substantially the same manner as shown in FIG. 1, the flows in FIG. 3 include the first stage premix flow (a), the secondary air flow (b), the mixture flow (c) after mixing of first stage premix and secondary air, the second stage premix flow (d), the spent gas flow (e) and the mixed gas flow (f) after mixing first stage and second stage streams and spent gas flow stream (e).

It is important in accordance with this invention that there is significant longitudinal spacing between the second stage port 34 and the first stage premix ports 27. This results in a unique blending of the spaced-apart flows (a) and (d), coupled with the associated flows existing in the area, to create the unique phenomena achieved by this invention.

It will accordingly be apparent that in the burners of FIGS. 1 and 3, the first stage premix (a) is preferably very lean, and mixes with the secondary air (b) (which is optional) and burns, if secondary air is present, in the cup as the stream (c). The preferably very lean first stage mix burns at a low temperature with low NOx emissions. At the same time, the second stage premix (d) which is preferably very rich enters the furnace at a high velocity and vigorously mixes with spent gases (e) from the furnace. The rich, second stage premix also burns with low NOx emissions. The momentum of stream (d) is predetermined to be strong enough to push streams (a) plus (b) down toward and along the burner block hot face (18) and furnace wall (10) of FIG. 3 and the corresponding furnace wall in FIG. 1, and the after-mixture (f) completes combustion along the furnace wall 10 (FIG. 3). The distance between the second stage premix ports 34 and the first stage premix ports 27 may be predetermined in an optimum manner to create a flat flame, and the projection of the second stage burner tip 34 may be similarly optimized, thus coacting to create a burner capable of producing very low NOx emissions.

Accordingly, it will be appreciated that the combustion in accordance with the operation of this burner may be considered to involve as many as three different zones of combustion. The first stage premix creates a zone of burning which attaches to the burner block and wall thus reducing pulsing or total flame detachment from the burner, which would be an unsafe condition.

The orifice sizes, which may be readily predetermined, provide a predetermined apportionment of fuel consumption as between the first stage and second stage. Although various ratios may be utilized, it has been found that an equal apportionment of fuel is optimum in many cases.

Since the first stage premix is preferably leaner than the second stage premix, the sizes of the respective tip ports and supply tube diameters may be used to control the air-to-fuel ratio of the total combustion. The second stage air-to-fuel ratio has been found to be optimum (for natural gas) at between about 1:1 and about 5:1, which is much below stoichiometric. The first stage premix preferably has an air-to-fuel ratio of about 15:1 to 20:1, which is quite lean and is well above stoichiometric (stoichiometric for methane is about 9:1). Some air may optionally enter the furnace as secondary air, if the secondary air feature is utilized. The secondary air flow may be controlled by predetermining the cross-sectional area of the secondary air passageway 35, the furnace draft and the position of the secondary air shutter 13. In many cases, a minimum NOx emission may be achieved with the use of no secondary air.

Accordingly, it will be apparent that the unique features of the burner as thus explained eliminate the need for precise and individual control on the part of the operator, require no more intervention than existing burners, and provide a burner which is less sensitive to tramp air than a conventional burner.

When burning fuel which contains hydrogen, most burners suffer from an increased generation of NOx emission. In contrast, the multi-staged inspiration burner in accordance with this invention tends to maintain the same level of NOx emission, or even a reduced level of NOx emission.

In accordance with the operation of the burner of this invention when the second stage air or fuel is shut off, the second stage premix velocity from the ports 34 is decreased and no longer serves to flatten the flame against the furnace wall. The resulting flame then becomes an involuting flame which is very stable. This is a valuable design feature which makes the burner easy to start in a cold furnace.

OPERATION

In operation of the burner in accordance with this invention, the shutters are set to a start-up position and first ignition is achieved by adjusting the shutter 42 to shut off the second stage premix air at 29 and to create a stoichiometric first stage premix in which first stage air is inspirated by orifices 25, 25. The resulting first stage premix flows out through first stage premix ports 27. With the second stage air shutter 41 closed, second stage fuel flows out the second stage premix ports 34 with no air. The secondary air shutter 13 is closed. When operating temperature has been reached, the shutters are readjusted. Lean first stage premix flows out the first stage premix ports 27. The secondary air shutter 13 is adjusted for existing furnace air requirements and if optional secondary air is provided it flows out the secondary air passageway 35. The streams meet, mix and burn in the cup or on the furnace wall. The second stage shutter 41 preferably is capable only of being fully open or fully closed, and is adjusted to the fully open position whereupon rich second stage premix flows out the premix ports 34 and is caused to burn at the furnace wall. Upon meeting and mixing with the lean first stage premix, it completes the combustion cycle in a manner to achieve a surprisingly low NOx emission.

It will be appreciated that in FIG. 1 the streams from the first stage premix ports 27 are directed outwardly along the cup surface of a burner block 11, while in FIG. 3 the emissions from the same first stage premix ports 27 are directed along the wall 10 of the furnace itself. In the descriptions and in the claims, we intend the cup wall and the furnace wall to be fully and functionally equivalent of each other, and that whenever mention is made in regard to the flow of the premix along the wall of the furnace, we intend this expression to encompass not only a flow directly along the wall 18 as in FIG. 3 but also a flow along the wall of a cup 11 which itself is positioned in and adjacent to the wall 10 as shown in FIG. 1.

It will accordingly be appreciated that it is important in accordance with this invention to provide a plurality of different premix mixtures to the combustion process along separate and distinct paths and to introduce the separate premix mixtures at separated locations within the combustion zone.

In the invention as shown in the drawing, a very lean mixture is introduced as a separate stage through the first stage premix ports 27, 27 adjacent the surface of the burner cup (or the furnace wall). Concurrently, an entirely separate stage of primary premix (of different composition) is introduced through second stage premix ports 34, this mixture preferably being a very rich mixture. Thus, it is highly advantageous in accordance with this invention to provide two different mixtures in two different locations at two different points, one mixture being substantially richer than the other. Preferably, one mixture is richer than stoichiometric while the other mixture is substantially leaner than stoichiometric. As a still further advantageous feature of the invention, the mixture stage which is leaner than stoichiometric is introduced substantially along the surface of the burner cup or the furnace wall while the substantially richer mixture stage is introduced at a point remote from the burner cup or furnace wall. Still further advantageously, the mixture which is richer than stoichiometric is introduced at a higher velocity than the other stage and in a direction serving to flatten the combustion mixture against either the burner cup or the adjacent surface of the furnace wall.

It will be appreciated that although the drawings have illustrated only two such stages of premix mixtures, it is possible to provide three or more than three, all separated from each other and so arranged as to achieve a staged combustion process. Further, it will be appreciated that the relative positions of the separated stages can be varied or modified in particular cases.

Reference is made to a co-pending U.S. application Ser. No. 07/795,808, filed of even date herewith by the same inventors and now U.S. Pat. No. 5,131,838. In that co-pending application, the premix is introduced at two spaced-apart locations, and each separately contacts a flow of secondary air entering the combustion zone. In that case the spaced-apart introductions of premix have the same composition as each other.

Although this invention has been shown and described in relation to particular burners, it will be appreciated that a wide variety of changes may be made without departing from the spirit and scope of this invention. Various spacings may be provided between the stages; various numbers of stages may be provided; the positions of the stages relative to each other may be reversed or modified. Changes may be made in degrees of richness or leanness in the respective stages. Certain features shown in the drawings may be modified or removed in specific cases, and secondary passageways and controls and other mechanical features may be varied or dispensed with without departing from the spirit and scope of the invention. Accordingly, the scope of the invention is not intended to be limited by the foregoing description, but only as set forth in the appended claims.

We claim:

1. A gaseous fuel burner comprising:

a burner body having a burner tip installed in a wall of a furnace having a combustion zone for gaseous fuel therein;

a first stage mixing means for mixing primary gaseous fuel and primary air as a premix, a first stage supply means for introducing said first stage premix of primary gaseous fuel and primary air forwardly along said burner body, a first stage premix port means extending into said furnace for supplying said first stage premix radially outwardly approximately adjacent to said wall to deliver said first stage premix substantially along said wall in said combustion zone;

a second stage mixing means for mixing primary gaseous fuel and primary air as a separate premix, a second stage supply means for introducing said second stage premix of primary gaseous fuel and primary air forwardly along said burner body, a second stage premix port means positioned in said combustion zone for separately supplying said second stage premix radially outwardly into the furnace from a predetermined location remote from said wall and separated along said burner from said first stage premix port means; and control means for independently controlling the fuel-to-air ratio of the premix in each of said first and second stages.

2. The gaseous fuel burner defined in claim 1 wherein said second stage mixing means is constructed to mix a second stage premix that is richer than stoichiometric and said first stage mixing means is constructed to mix a first stage premix that is leaner than stoichiometric.

3. The gaseous fuel burner defined in claim 1 which further comprises means for adjustably positioning the first stage premix port means and the second stage premix port means along said burner to predetermine the spacing of one stage of premix port means from the other stage premix port means.

4. The gaseous fuel burner defined in claim 1 wherein one of said port means is adjustably positioned to vary its projection relative to the furnace wall.

5. The gaseous fuel burner defined in claim 1 wherein means are provided for providing secondary air adjacent the first stage premix port means.

6. The gaseous fuel burner defined in claim 5 including means for shutting off said secondary air.

7. The gaseous fuel burner defined in claim 1 wherein said second stage premix is introduced adjacent the end of said second stage premix port means, and wherein means is provided for controlling said air-to-fuel ratio of said second stage premix from about 1:1 to about 5:1.

8. The gaseous fuel burner defined in claim 1 wherein said wall has a surface area selected from the group consisting of a cup-shaped recess and a flat surface.

9. The gaseous fuel burner defined in claim 8 wherein the position of said first stage premix port is arranged to direct introduction of said first stage premix adjacent the surface area of said cup-shaped recess or flat surface and wherein controlling means is provided for controlling the air-to-fuel ratio of said first stage premix from about 15:1 to 20:1.

10. The gaseous fuel burner defined in claim 1 further comprising controlling means for adjusting and predetermining volumetric flows of said separate stages to provide a substantially equal fuel flow ratio.

11. A gaseous fuel burner comprising:

a burner body having a burner tip installed in a wall of a furnace having a combustion zone for gaseous fuel therein;

a first stage mixing means for mixing primary gaseous fuel and primary air as a premix, a first stage supply means for introducing said first stage premix of primary gaseous fuel and primary air forwardly along said burner body, a first stage premix port means positioned for supplying said first stage premix radially outwardly approximately adjacent to said wall in said combustion zone to direct said first stage premix substantially along said wall;

a second stage mixing means for mixing primary gaseous fuel and primary air as a separate premix, a second stage supply means for introducing said second stage premix of primary gaseous fuel and primary air forwardly along said burner body, a second stage port means positioned in said combustion zone for separately supplying said second stage premix radially outwardly into the furnace from a predetermined location remote from said wall and separated along said burner from said first stage premix port means;

means for supplying and directing secondary air approximately adjacent to said furnace wall and said first stage port means in said combustion zone; and means for independently controlling and predetermining air-to-fuel ratios of said first stage premix and said second stage premix.

12. The gaseous fuel burner defined in claim 1 further comprising means for predetermining air-to-fuel ratios of said first stage premix and said second stage premix wherein one of said stages is substantially richer in fuel than the other of said stages.

13. The combination of the burner and furnace as defined in claim 1, wherein said combustion zone includes a burner cup and wherein said first stage premix port means is located in said burner cup and wherein said second stage premix port means is located in said furnace outside said burner cup.

* * * * *